US008596445B2

(12) United States Patent
Ye et al.

(10) Patent No.: US 8,596,445 B2
(45) Date of Patent: Dec. 3, 2013

(54) BALUSTRADE AND DECK MOUNTING ASSEMBLY FOR A PASSENGER CONVEYOR

(75) Inventors: Ke Ye, Guangzhou (CN); Yanying Chen, Guangzhou (CN); Ruoming Tian, Guangzhou (CN); Songjian He, Guangzhou (CN); Shouhong Wang, Wangjiafan Village (CN); Ruzhuang Zhao, Jiangmen (CN); Coliu Wu, Guangdong (CN); Zhigao Mai, Shaoguan (CN); Yongjun Huang, Guangdong (CN); Richard Qingdong Jiang, Guangdong (CN)

(73) Assignee: Otis Elevator Company, Farmington, CT (US)

( * ) Notice: Subject to any disclaimer, the term of this patent is extended or adjusted under 35 U.S.C. 154(b) by 45 days.

(21) Appl. No.: 13/259,510

(22) PCT Filed: Apr. 20, 2009

(86) PCT No.: PCT/IB2009/005291

§ 371 (c)(1),
(2), (4) Date: Jan. 26, 2012

(87) PCT Pub. No.: WO2010/122364

PCT Pub. Date: Oct. 28, 2010

(65) Prior Publication Data

US 2012/0111695 A1 May 10, 2012

(51) Int. Cl.
*B66B 23/22* (2006.01)

(52) U.S. Cl.
USPC ..... 198/335

(58) Field of Classification Search
USPC ..... 198/321, 335
See application file for complete search history.

(56) References Cited

U.S. PATENT DOCUMENTS

| | | | | | |
|---|---|---|---|---|---|
| 3,926,296 | A | * | 12/1975 | Woodling et al. | 198/325 |
| 3,991,877 | A | * | 11/1976 | Kraft et al. | 198/335 |
| 4,690,264 | A | * | 9/1987 | Adrian et al. | 198/335 |
| 4,819,781 | A | * | 4/1989 | Saito et al. | 198/335 |
| 4,842,122 | A | * | 6/1989 | Van Nort | 198/335 |
| 5,029,690 | A | | 7/1991 | Nguyen et al. | |
| 5,180,047 | A | | 1/1993 | Barrett et al. | |

(Continued)

FOREIGN PATENT DOCUMENTS

| | | |
|---|---|---|
| CN | 1099004 | 2/1995 |
| JP | 2001261273 A | 9/2001 |

(Continued)

OTHER PUBLICATIONS

English Translation of Chinese Office Action, mailed Apr. 22, 2013.

(Continued)

*Primary Examiner* — James R Bidwell
(74) *Attorney, Agent, or Firm* — Kinney & Lange, P.A.

(57) ABSTRACT

A balustrade assembly includes a decking panel and a skirt panel that are attached to one another and to a balustrade support structure without fasteners. A positioning device included in the balustrade assembly varies the position of the skirt panel relative to moving steps in two directions by pushing against stationary components that are a part of or otherwise connected to a frame of a passenger conveyor. A balustrade support employed in the assembly reduces material and manufacturing costs and is adjustable to vary the height of a balustrade panel and handrails in a passenger conveyor.

29 Claims, 8 Drawing Sheets

(56) References Cited

U.S. PATENT DOCUMENTS

| | | | | |
|---|---|---|---|---|
| 5,215,177 | A * | 6/1993 | Johnson et al. | 198/335 |
| 5,307,919 | A * | 5/1994 | Wente et al. | 198/335 |
| 8,123,020 | B2 * | 2/2012 | Fang et al. | 198/335 |

FOREIGN PATENT DOCUMENTS

| | | | |
|---|---|---|---|
| JP | 2002326781 | A | 11/2002 |
| JP | 2002332185 | A | 11/2002 |
| JP | 2004196443 | | 7/2004 |
| JP | 2007157262 | A | 6/2007 |
| JP | 2007161447 | | 6/2007 |

OTHER PUBLICATIONS

English Translation of Chinese Search Report, dated Apr. 9, 2013.
The Feb. 23, 2010 International Search Report for International Application No. PCT/IB2009/005291.
English Translation of Japanese Office Action, dated Jul. 24, 2013.

* cited by examiner

BALUSTRADE AND DECK MOUNTING ASSEMBLY FOR A PASSENGER CONVEYOR

BACKGROUND

This invention relates to an improved mounting assembly for the balustrade, and decking and skirt panel of a passenger conveyor.

Escalators, moving walkways, and other passenger conveyors commonly include a series of tread plates, a frame, a drive, a step chain and a pair of balustrade assemblies. In escalators, for example, the frame comprises a truss on both the left and right hand sides of the frame between which the steps are positioned. Each truss has two end sections forming landings, connected by an inclined midsection. Matching pairs of roller tracks are attached on the inside of each truss, i.e. the side of the truss facing the other truss. The upper landing usually houses the escalator drive between the trusses. The drive powers a pair of step chain sprockets, which in turn impart motion to the step chain to move the tread plates. The tread plates travel a closed loop as they are guided along the roller tracks running from one elevation to the other elevation, and back. For safety reasons, passenger handrails are provided, traveling in the same direction and speed as the tread plates. A balustrade assembly supports and guides a handrail on each side of the tread plates.

Each balustrade assembly includes a balustrade panel that extends up from a base to support the handrail. Externally, the base consists of outer and inner balustrade decking and a skirt panel. The outer decking encloses the mechanics on the side of the balustrade panel opposite the moving tread plates. The inner decking encloses the mechanics adjacent the moving tread plates. The inner decking also provides a transition section between the balustrade panel and the skirt panel. Internally, the base consists of a support structure that is attached to the frame and supports the balustrade panel and handrails.

The skirt panel lies in close proximity to, but out of contact with, the moving tread plates. The skirt panel is generally positioned in close proximity to the tread plates to decrease the likelihood that objects or body parts of passengers are pulled into and trapped in the gap between the stationary skirt panel and the moving tread plates. Also, to prevent pinching between the panel and the tread plates, the skirt panel is often a rigid panel. Skirt panels are typically assembled from structural members and sheet metal. Generally speaking, the sheet metal provides the surface in close proximity to the tread plates and the structural members add rigidity to the fabrication. The hardware necessary to locate and hold the skirt panel relative to the tread plates may depend upon and be incorporated into the structural members.

There is a continuing need to decrease material cost and complexity of balustrade assemblies without sacrificing structural requirements and to reduce the time and cost of installing and repairing such assemblies.

SUMMARY

A passenger conveyor balustrade assembly includes a balustrade support, a decking panel, a skirt panel, and first and second flexible bands. The balustrade support is configured to be fixed to a frame of the passenger conveyor. The first flexible band connects a first side of the decking panel to the balustrade support such that the decking panel generally protrudes away from a balustrade panel projecting up from the balustrade support. The second flexible band connects a second side of the decking panel to a first side of the skirt panel and the second side of the decking panel and the first side of the skirt panel to the balustrade support such that the skirt panel is offset from and generally parallel to the balustrade panel.

DETAILED DESCRIPTION

Figure 1:
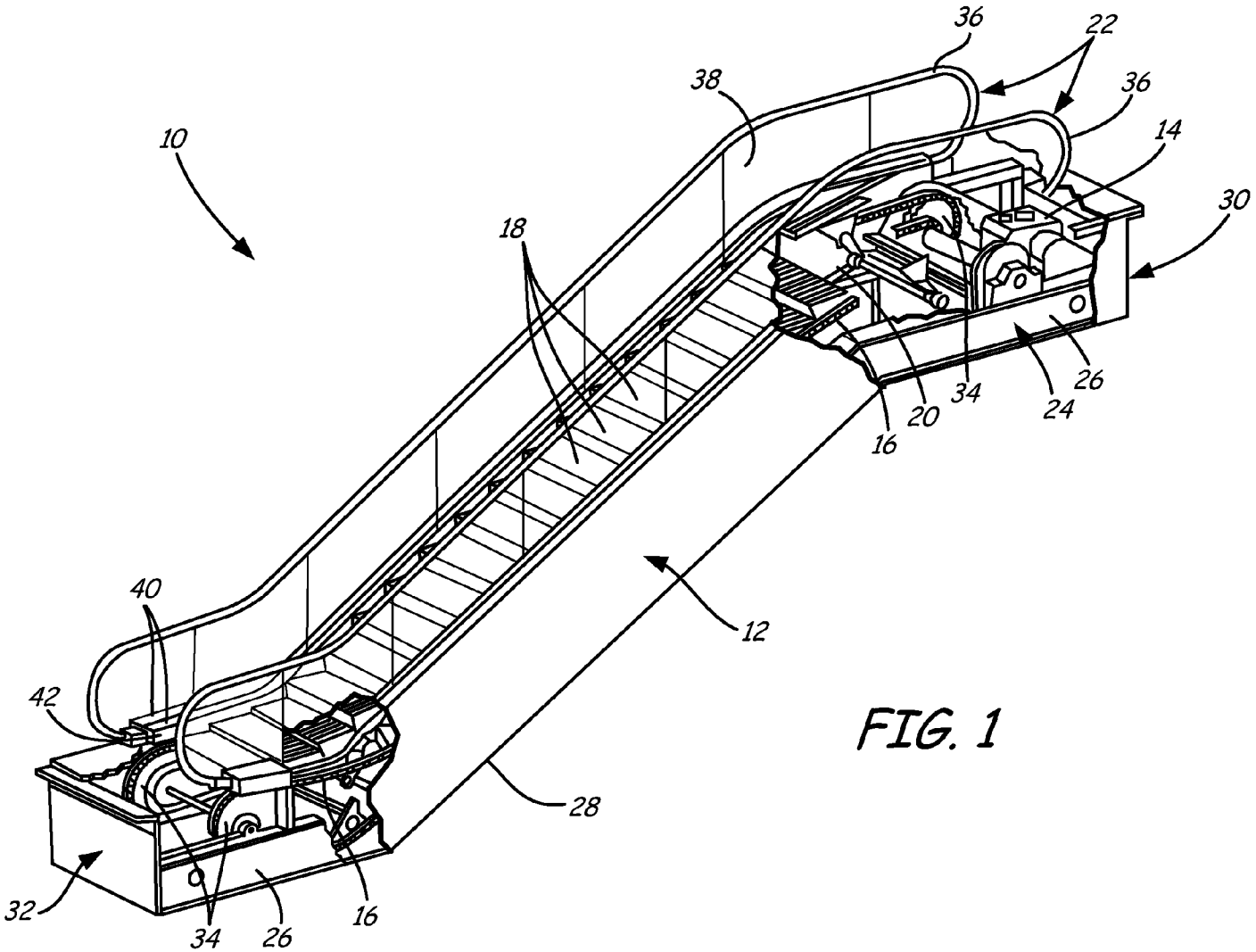
FIG. 1 is a perspective view of an escalator.

FIG. 1 is broken perspective view of escalator 10 including frame 12, drive 14, step chain 16, steps 18, roller tracks 20, and balustrade assemblies 22. Frame 12 includes one truss 24 on both the left and right hand sides of frame 12 (only one side is shown in FIG. 1). Each truss 24 has two end sections 26 parallel to one another, connected by an inclined midsection 28. The end sections 26 form upper landing 30 and lower landing 32. Matching pairs of roller tracks 20 are attached on the inside of each truss 24, i.e. the side of truss 24 facing the other truss 24. Upper landing 30 houses escalator drive 14, between trusses 24. Drive 14 powers a pair of step chain sprockets 34, which in turn impart linear motion to step chains 16. Steps 18 are connected to step chains 16 and are thereby driven along with step chains 16 by escalator drive 14. Step chains 16 and steps 18 travel through a closed loop path, running from one elevation (i.e. one of upper or lower landing 30, 32) to the other elevation (30 or 32), and back.

Balustrade assembly 22 includes handrail 36, balustrade panel 38, decking 40, and skirt panel 42. Balustrade panels 38 protrude up through decking 40 on either side of steps 18 to support handrails 36. Decking 40 covers the underlying support structure of balustrade assemblies 22 (discussed in more detail below). Skirt panel 42 is connected on the inner side of balustrade panel 38 (i.e. side facing steps 18) to decking 40 and is arranged in close proximity to, but out of contact with, moving steps 18. On each side of steps 18, handrail 36 is driven either by escalator drive 14 or by an independent handrail drive (not shown) in the same direction and speed as steps 18. Handrails 36 enable the passenger(s) (not shown) to steady themselves while riding the escalator.

Figure 2A:
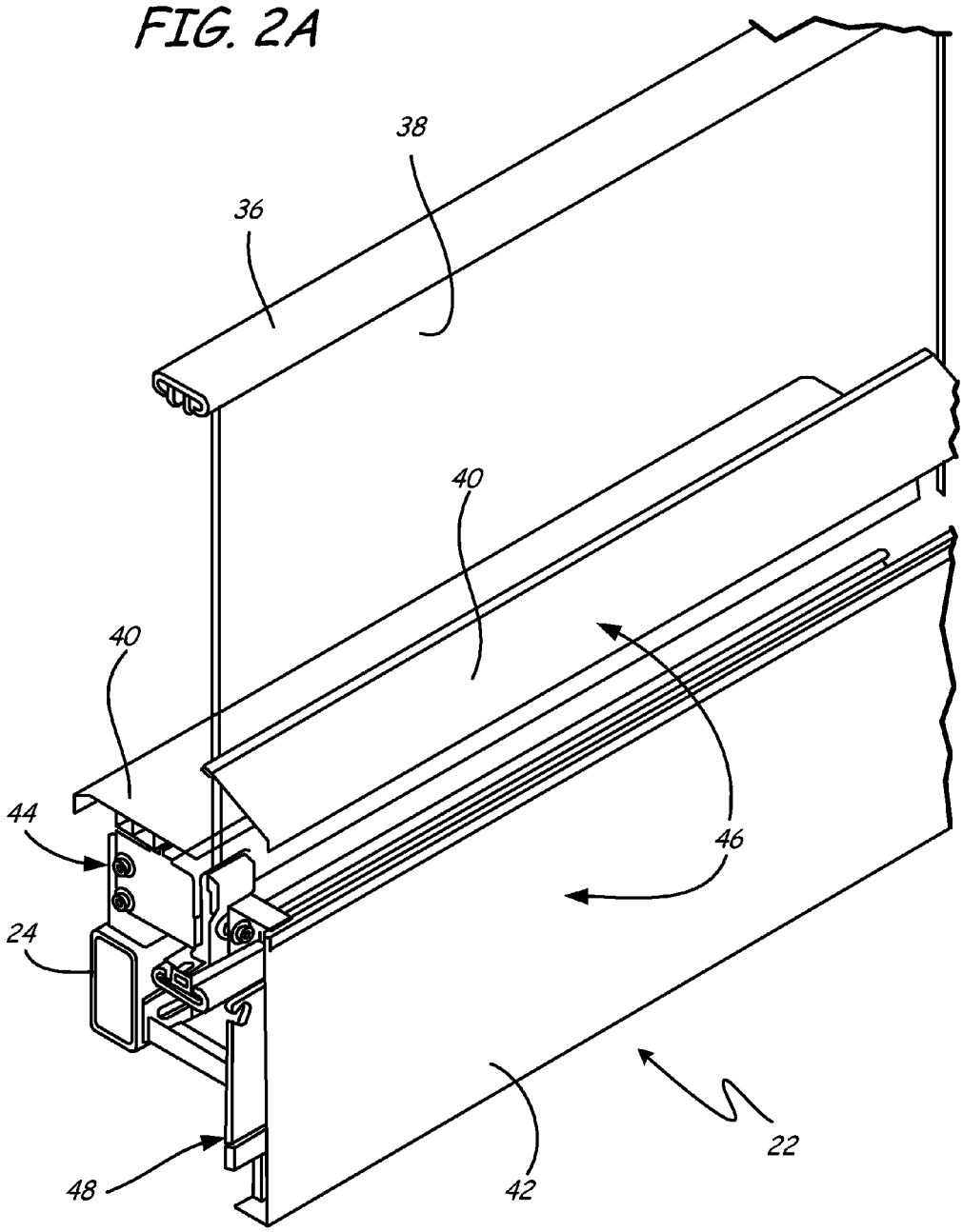
FIGS. 2A and 2B are detail views of a balustrade assembly according to the present invention that is employed in the escalator of FIG. 1.
Figure 2B:
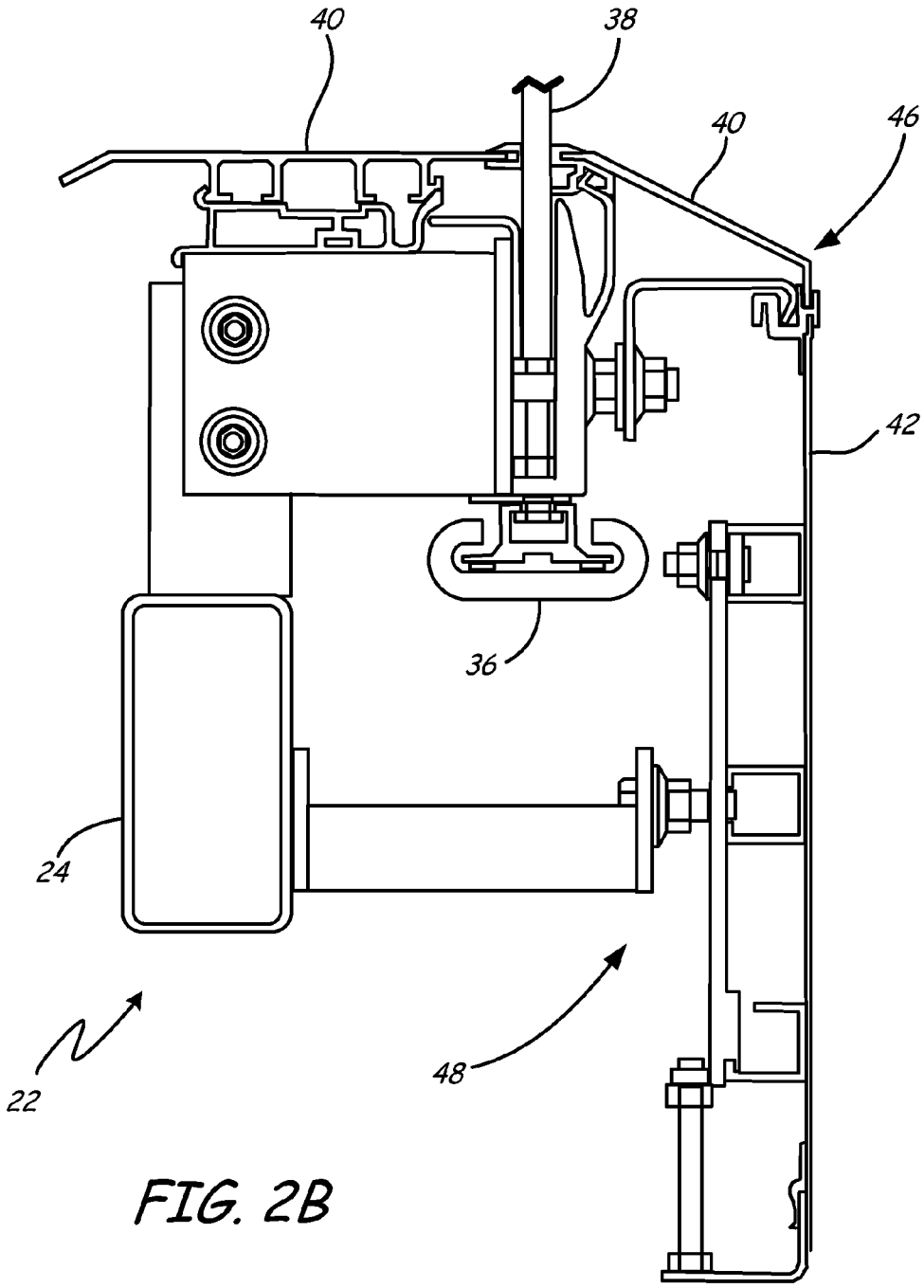

FIGS. 2A and 2B are detail views of balustrade assembly 22. FIG. 2A is a perspective view and FIG. 2B is a section view of balustrade assembly 22. Balustrade assembly 22 includes handrail 36, balustrade panel 38, decking 40, skirt panel 42, support structure 44, balustrade decking and skirt panel assembly 46, and skirt panel positioning device 48. Escalator 10 shown in FIG. 1 includes truss 24 on which all of the components of escalator 10 are mounted. Truss 24 extends the length of escalator 10 and is arranged generally parallel, or equally spaced from the sides of steps 18. In addition to its structural function, truss 24 also acts as a stationary reference from which the remaining components of escalator 10 may be located. In FIGS. 2A and 2B, support structure 44 includes a number of generally rigid, fixed structural members that are connected to truss 24 on either side of steps 18 to support balustrade assemblies 22. Handrail 36, balustrade panel 38, and decking and skirt panel assembly 46 are all connected to and supported by support structure 44. Skirt panel positioning device 48 is connected to skirt panel 42.

Adjustable Balustrade Panel Support

Balustrade assemblies of passenger conveyors include structural support for the balustrade panel and handrails. The rigid supports are connected to the conveyor frame and are commonly in the form of extruded aluminum channels. While the aluminum channels provide good weight to strength characteristics and multiple functions in a single shape (e.g. multiple channels for mounting various components in addition to balustrade panel), they also are expensive due to material costs and the complexity of manufacturing the relatively complex geometry. Embodiments of the present invention therefore provide a balustrade support that reduces material and manufacturing costs and that is also adjustable to vary the height of the balustrade panel and handrails in the passenger conveyor.

Figure 3A:
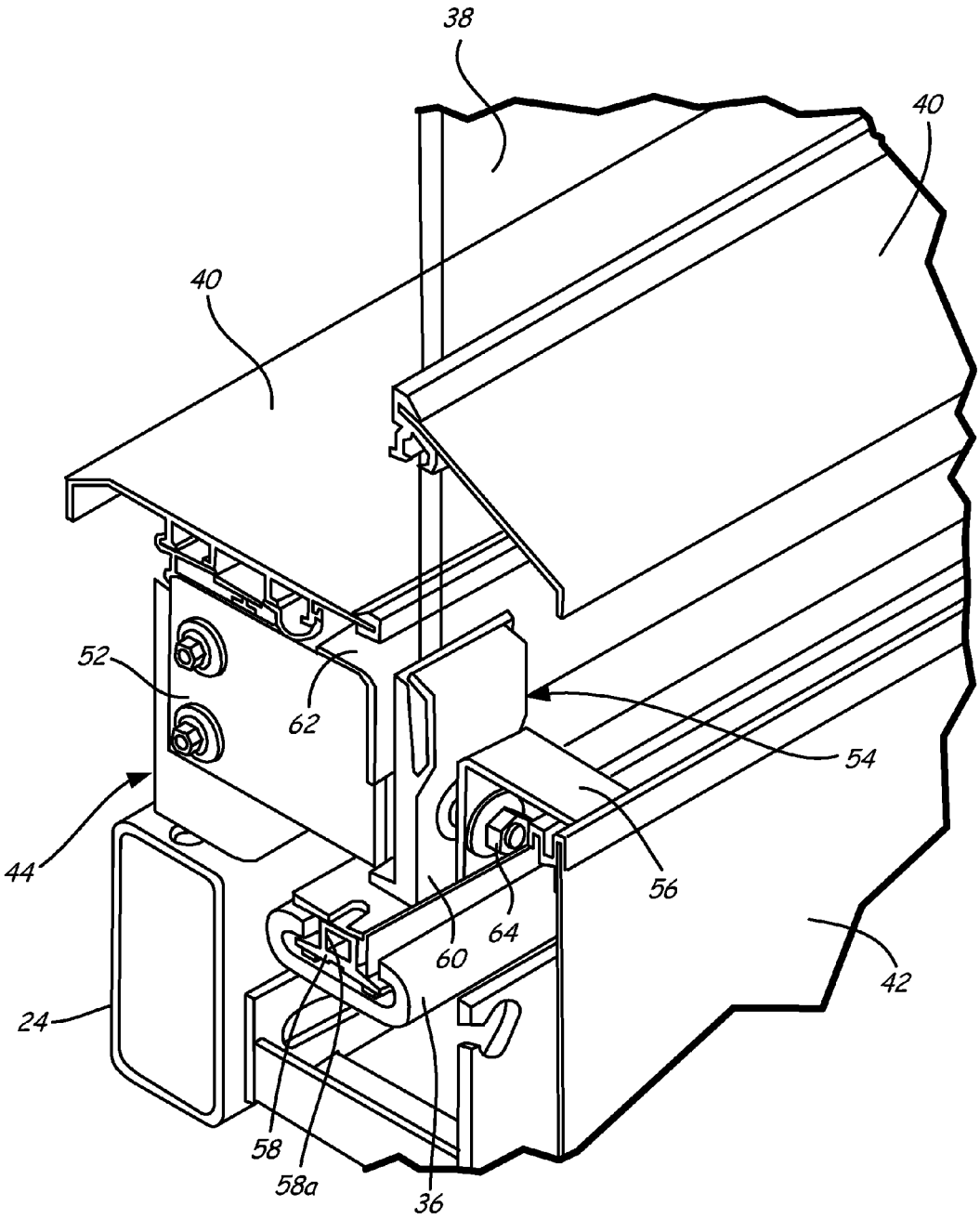
FIGS. 3A and 3B are detail views of the support structure employed in the balustrade assembly of FIGS. 2A and 2B.
Figure 3B:
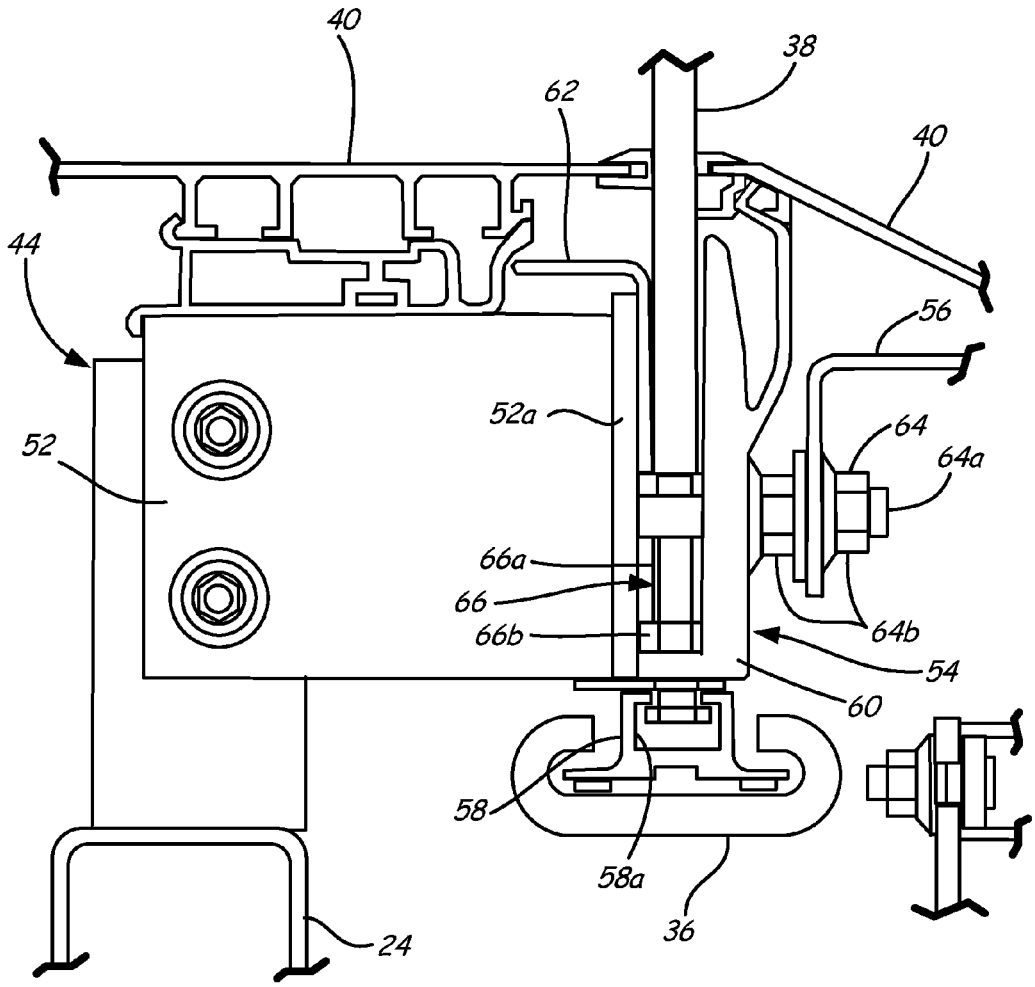

FIGS. 3A and 3B are detail views of support structure 44 including anchor brackets 52, balustrade panel support 54, hooks 56 and handrail guides 58. Anchor brackets 52 are attached to truss 24 at spaced apart points along the length of truss 24 adjacent steps 18 (not shown). Balustrade panel support 54 includes support plates 60 and "L" bracket 62. Support plates 60 are connected to anchor brackets 52 by first fasteners 64 at spaced apart points along the length of truss 24. Clamped between balustrade panel support plates 60 and anchor brackets 52 is balustrade panel 38. To add rigidity to balustrade panel support 54 along the length of truss 24, "L" bracket 62 is wedged between balustrade panel 38 and plate 52*a* of anchor bracket 52 on a side of panel 38 opposite support plates 60. Unlike the multiple, spaced apart support plates 60, "L" bracket 62 may be a single elongated bracket that runs substantially all of the length of truss 24. Attached to support plates 60, also by first fasteners 64, are hooks 56. First fastener 64 may include, for example, threaded bolt 64*a* and several locknuts 64*b* for progressively securing support plate 60 and hook 56.

Handrail guides 58 are also connected to anchor brackets 52. Guides 58 may be formed from, for example, extruded high density polyethylene, and may each be several inches long. Thus, each of anchor brackets 52 will support one handrail guide 58. Guide 58 is formed with slot 58*a* to which second fastener 66 fastens anchor bracket 52. Guide 58 is itself generally T-shaped so as to telescopingly receive handrail 36.

Balustrade support 54 forms what has been previously referred to as a "balustrade support channel." Balustrade support channels have commonly been relatively complex and expensive extruded aluminum members, which in a typical escalator assembly will be about thirteen feet long in the incline, and which provide full support for the glass balustrade panels 38. Balustrade support 54, on the other hand, includes support plates 60 and "L" bracket 62, both of which are relatively simple and inexpensive components. Support plates 60 may be, for example, aluminum plates adapted for the particular passenger conveyor in which they are installed. Plates 60 are relatively small and simple in design and therefore reduce material and manufacturing costs over more complex designs such as prior balustrade support channels. "L" bracket 62 may be an off-the-shelf steel angle iron that is cut and shaped to fit the intended application. "L" bracket 62 adds rigidity to balustrade support 54 without the complexity and cost of prior designs, including long extruded support channels.

In addition to simplifying the design and reducing the cost of supporting handrail 36 and balustrade panel 38, balustrade support 54 is also configured to adjust the height of panel 38 in escalator 10 (shown in FIG. 1). As discussed above, handrail guide 58 is attached to anchor bracket 52 by second fastener 66. Second fastener 66 may include, for example, threaded bolt 66*a* with one or more locknuts 66*b*. Second fastener 66 not only connects handrail guide 58 to bracket 52, but fastener 66 also acts to adjust the height of balustrade panel 38. Bolt 66*a*, which in some embodiments may simply be a threaded shank, may be vertically adjusted by locknut 66*b*, which in turn pushes up or lets down balustrade panel 38, the bottom of which abuts the top of bolt 66*a*.

Balustrade Decking and Skirt Panel Assembly

During operation of escalators, fasteners that are used to connect components may loosen due to vibrations generated by any number of systemic conditions. In the event such fasteners are located on the exterior of the escalator in proximity to passengers, there is a persistent safety risk that a loosened fastener may hitch or otherwise contact the passenger's clothing or body. Therefore, in order to increase passenger safety, improve aesthetics, and reduce installation complexity and costs, embodiments of the present invention provide balustrade assemblies in which the balustrade decking panel and skirt panel are attached to one another and to the balustrade support structure without fasteners.

Figure 4:
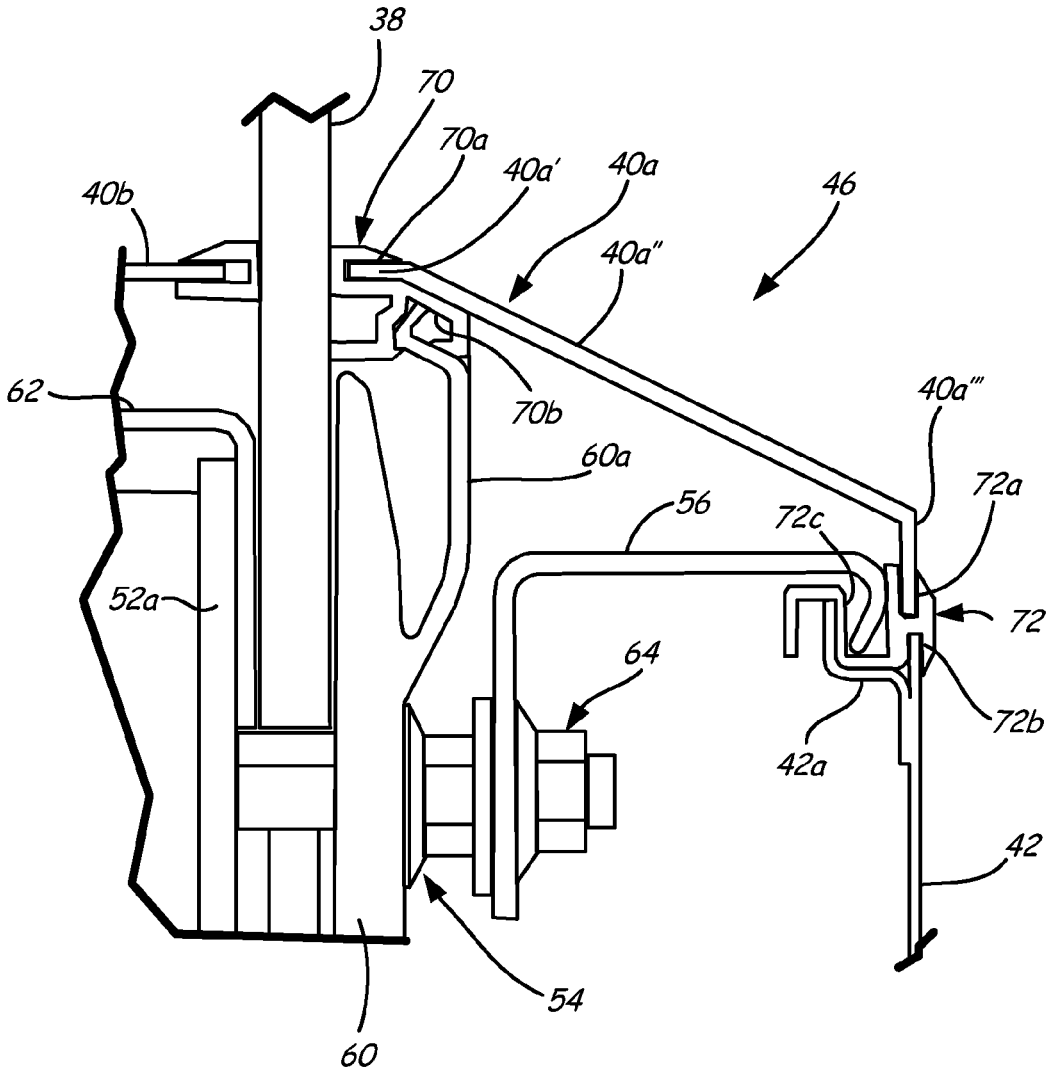
FIG. 4 is a section view of the balustrade decking and skirt panel assembly employed in the balustrade assembly of FIGS. 2A and 2B.

FIG. 4 is a section view of balustrade decking and skirt panel assembly 46 including balustrade decking 40, skirt panel 42, panel support plate 60, hook 56, and first and second flexible bands 70, 72. Decking 40 includes inner and outer decking panels 40*a*, 40*b* arranged on the inner side, i.e. the side facing steps 18 (not shown), and the outer side of balustrade panel 38. Inner decking 40*a* may be fabricated from, for example, bent sheet metal and includes first portion 40*a*', second portion 40*a*", and third portion 40*a*"'. First portion 40*a*' is received in slot 70*a* of first band 70 and is approximately perpendicular to balustrade panel 38. Second portion 40*a*" extends at a declined acute angle from first portion 40*a*'. Third portion 40*a*"' extends from second portion 40*a*" approximately parallel to balustrade panel 38. Support plate 60 includes contoured fin 60*a* that extends from plate 60 toward first band 70 and inner decking 40*a*. First band 70 includes slot 70*a* and generally "C" shaped channel 70*b*. Second band 72 includes first and second slots 72*a*, 72*b*, and generally "U" shaped channel 72*c*.

In FIG. 4, first flexible band 70 receives first portion 40*a*' of inner decking 40*a* in slot 70*a*. First band 70 is connected to balustrade support 54 by contoured receiving fin 60*a* in C-shaped channel 70*b*. Fin 60*a* acts as a clip that is received by channel 70*b* and resiliently retains first band 70 and inner decking 40*a*. Second flexible band 72 receives skirt panel 42 in second slot 72*b*. Skirt panel 42 includes "L" shaped flange 42*a* that is configured to receive and partially surround channel 72*c*. Skirt panel 42 and second band 72 are connected to balustrade support 54 by hook 56. Hook 56 is a bent plate that is attached to and extends from balustrade support plate 60 using first fastener 64 generally perpendicular to balustrade panel 38. Second flexible band 72 receives third portion 40*a*"' of inner decking 40*a* in first slot 72*a*, thereby securing decking 40*a* and skirt panel 42 to one another and to balustrade support 54. First and second flexible bands 70, 72 may be manufactured by, for example, extruding an inexpensive plastic including, for example, polyvinyl chloride (PVC). Other suitable manufacturing methods and materials may be used.

Skirt Panel Positioning Device

Skirt panels in escalators and other passenger conveyors are attached to the frame of the escalator, and therefore remain fixed as the steps move therebetween. The gap between the steps and the skirt panel is kept very small to decrease the likelihood that objects are pulled into and trapped in this gap. Designing escalators with a very small gap between steps and skirt panels significantly increases installation and maintenance costs and complexity because the skirt panel needs to be positioned precisely with respect to the escalator steps at every installation. Embodiments of the present invention therefore provide a device that varies the position of the skirt panel relative to the moving steps in two directions by pushing against stationary components that are a part of, or otherwise connected to, the escalator frame.

Figure 5A:
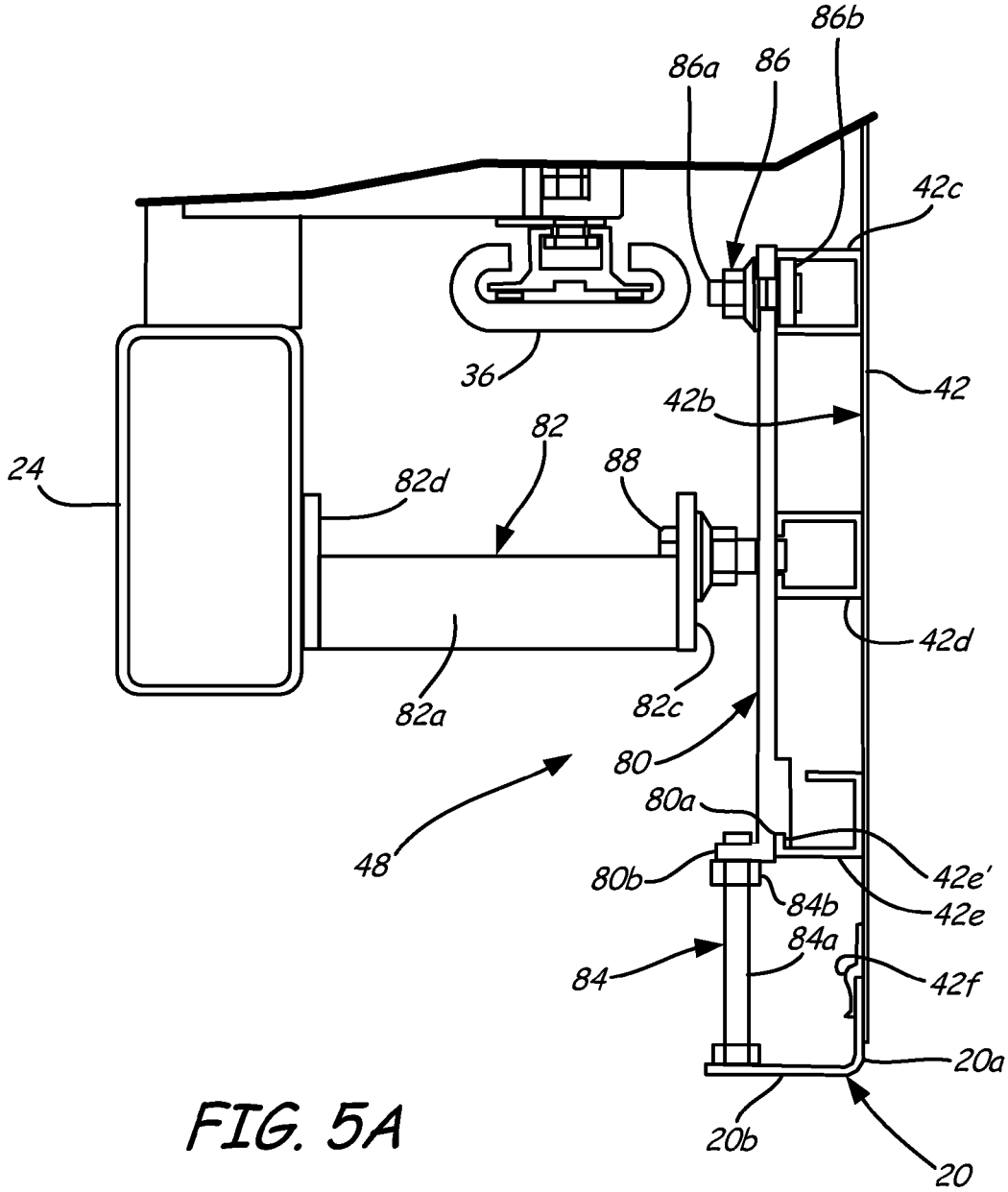
FIGS. 5A and 5B are detail views of the skirt panel positioning device employed in the balustrade assembly of FIGS. 2A and 2B.
Figure 5B:
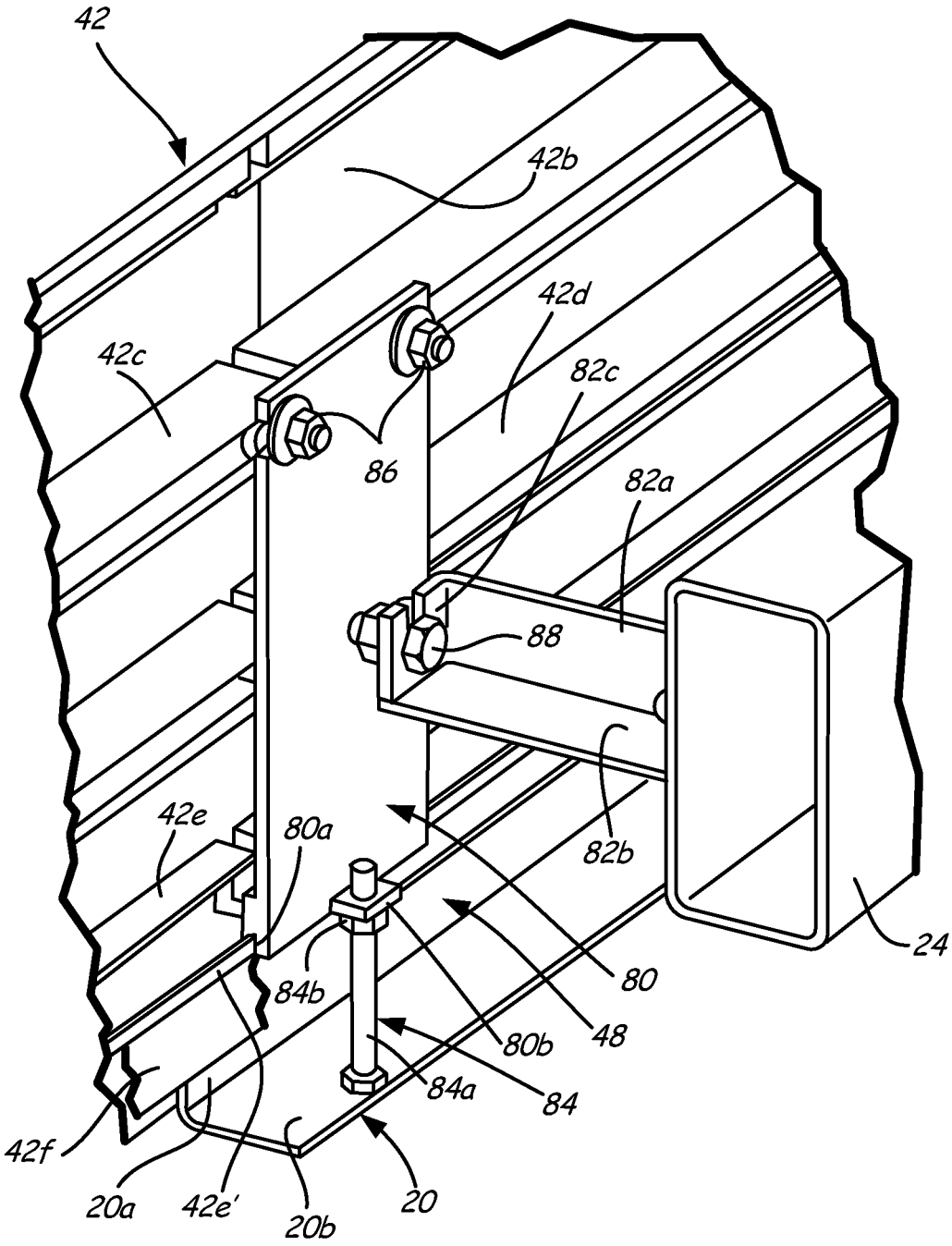

FIGS. 5A and 5B are detail views of skirt panel positioning device 48 including plate 80, bracket 82, and post 84. FIG. 5A is a section view and FIG. 5B is a perspective view of positioning device 48. In FIGS. 5A and 5B, plate 80 is connected to an inner face 42*b* of skirt panel 42, i.e. the face of skirt panel 42 facing away from steps 18 (not shown in FIGS. 5A and 5B) toward truss 24. Skirt panel 42 includes three channels 42*c*, 42*d*, and 42*e* on inner face 42*b* to which plate 80 is connected. Plate 80 is connected to first channel 42*c* by fasteners 86. Fasteners 86 may include, for example, bolt 86*a* with "T" shaped head 86*b* that mates with "C" shaped channels 42*c*. Third channel 42*e* is arranged below first channel 42*c* and includes lip 42*e*' that is configured to be received in slot 80*a* of plate 80. Second channel 42*d* is interposed between first and third channels 42*c*, 42*e*.

Bracket 82 is adjustably connected to plate 80 extending away from steps 18 generally perpendicular to skirt panel 42. Bracket 82 includes first, second, third, and fourth walls 82*a*, 82*b*, 82*c*, 82*d*. First wall 82*a* extends away from steps 18 generally perpendicular to skirt panel 42. Second wall 82*b* (shown in FIG. 5B) extends away from steps 18 generally perpendicular to skirt panel 42 and is connected in approximately perpendicular relationship to first wall 82*a*. Third wall 82*c* is arranged generally parallel to skirt panel 42 and is connected to one end of first and second walls 82*a*, 82*b*. Fourth wall 82*d* is arranged generally parallel to skirt panel 42 and is connected to the other end of first and second walls 82*a*, 82*b*. Third wall 82*c* is connected to plate 80 by adjustable fastener 88 such that adjustment of fastener 88 moves bracket 82 further away or closer to skirt panel 42. As bracket 82 is adjusted to move further away from skirt panel 42, bracket 82 eventually abuts truss 24 to adjust the position of skirt panel 42 in a first direction, for example in a horizontal direction.

Post 84 is adjustably connected to plate 80 extending down from the bottom of plate 80 generally parallel to skirt panel 42. In FIGS. 5A and 5B, a portion of roller track 20 is shown. Track 20 is arranged below skirt panel 42 and is "L" shaped with vertical leg 20*a* and horizontal leg 20*b*. Skirt panel 42 includes clip 42*f* that is configured to receive an end of vertical leg 20*a* of track 20. Post 84 includes threaded bolt 84*a* and locknut 84*b*. Bolt 84*a* is threadably connected to platform 80*b* on plate 80 and locknut 84*b* sets the distance that bolt 84*a* protrudes down from platform 80*b*. By adjusting bolt 84*a* and locknut 84*b*, post 84 is configured to abut track 20 arranged below skirt panel 42 to adjust the position of skirt panel 42 in a second direction, e.g. in a vertical direction. Positioning device 48 is therefore configured to vary the position of skirt panel 42 relative to moving steps 18 in two directions by pushing against stationary components truss 24 and roller track 20 that are a part of, or otherwise connected to, escalator frame 12.

Embodiments of the present invention provide improved balustrade assemblies with several features including a balustrade support, a decking and skirt panel assembly, and a skirt panel positioning device. The balustrade support employs less material and less complex components than prior extruded aluminum balustrade support channels. The balustrade support is also adjustable to vary the height of a balustrade panel and handrail in a passenger conveyor. The balustrade decking and skirt panel assembly connects the decking and the skirt panel to one another and to the frame of a balustrade support structure. The skirt panel positioning device varies the position of a skirt panel relative to moving steps in two directions by pushing against stationary components that are a part of, or otherwise connected to, a passenger conveyor frame.

Although the present invention has been described with reference to preferred embodiments, workers skilled in the art will recognize that changes may be made in form and detail without departing from the spirit and scope of the invention.

The invention claimed is:

1. A passenger conveyor balustrade assembly comprising:

a skirt panel configured to be arranged adjacent a plurality of tread plates, the skirt panel having an inner face facing away from said tread plates;

a frame member arranged laterally from the skirt panel away from the tread plates;

a track arranged below the skirt panel;

a plate connected to the inner face of the skirt panel and disposed generally parallel thereto;

a first member adjustably connected to the plate opposite the skirt panel and extending away from the skirt panel generally perpendicular thereto, the first member being adjustable to engage the frame member such that the first member can adjust a position of the skirt panel in a first direction; and a second member adjustably connected to the plate and extending generally parallel to the skirt panel and configured to engage the track such that the second member can adjust the position of the skirt panel in a second direction.

2. The balustrade assembly of claim 1, wherein the skirt panel comprises a plurality of channels disposed on the inner face of the skirt panel, the plate being connected to at least one of said channels.

3. The balustrade assembly of claim 2, wherein the plurality of channels comprise:

a first channel to which the plate is connected by one or more fasteners; and a second channel arranged below the first channel and comprising a lip configured to be received in a slot in the plate.

4. The balustrade assembly of claim 3, wherein the plurality of channels further comprise a third channel arranged between the first and the second channels.

5. The balustrade assembly of claim 1, wherein the track comprises a vertical leg and a horizontal leg against which the second member is configured to abut the track; and wherein the skirt panel comprises a clip configured to receive an end of the vertical leg of the track.

6. The balustrade assembly of claim 1, wherein the first member comprises a bracket including:

a first wall extending away from the skirt panel generally perpendicular thereto;

a second wall extending away from the skirt panel generally perpendicular thereto, and connected in approximately perpendicular relationship to the first wall;

a third wall arranged generally parallel to the skirt panel and connected to first ends of the first and the second walls; and a fourth wall arranged generally parallel to the skirt panel and connected to second ends of the first and the second walls opposite the first ends of the first and second walls.

7. The balustrade assembly of claim 6, wherein one of the third and the fourth walls is connected to the plate by an adjustable fastener such that adjustment of the fastener moves the bracket relative to the skirt panel, the relative movement of the bracket being limited by the frame member, against which the bracket may be adjusted to abut.

8. The balustrade assembly of claim 7, wherein the bracket can adjust a position of the skirt panel in a first direction when the bracket is adjusted to abut against the frame member.

9. The balustrade assembly of claim 1, wherein the second member comprises a post connected to the plate by an adjustable fastener such that adjustment of the fastener moves the post.

10. The balustrade assembly of claim 9, wherein the relative movement of the post is limited by the track, against which the post may be adjusted to abut.

11. The balustrade assembly of claim 10, wherein the post can adjust a position of the skirt panel in a second direction when the post is adjusted to abut against the track.

12. A passenger conveyor comprising:

a frame member;

a conveyor drive connected to the frame member;

a step chain driven by the conveyor drive;

a plurality of tread plates connected to the step chain;

a step chain guide track configured to receive one or more rollers on each tread plate to guide the tread plates as they are driven by the step chain;

a skirt panel arranged adjacent the tread plates, the skirt panel having an inner face facing away from the tread plates; and a positioning device comprising:

a plate connected to an inner face of the skirt panel;

a first member adjustably connected to the plate opposite the skirt panel and extending away from the skirt panel generally perpendicular thereto and configured to engage the frame member to adjust a position of the skirt panel in a first direction; and a second member adjustably connected to the plate and extending generally parallel to the skirt panel and configured to engage the track such that the second member can adjust the position of the skirt panel in a second direction.

13. The passenger conveyor of claim 12, wherein the skirt panel comprises a plurality of channels on the inner face of the skirt panel and wherein the plate is connected to at least one of the channels.

14. The passenger conveyor of claim 13, wherein the plurality of channels comprise:

a first channel to which the plate is connected by one or more fasteners; and a second channel arranged below the first channel and comprising a lip configured to be received in a slot in the plate.

15. The passenger conveyor of claim 14, wherein the plurality of channels further comprise a third channel arranged between the first and the second channels.

16. The passenger conveyor of claim 12, wherein the track comprises an "L" shape portion having a vertical leg, and a horizontal leg against which the second member is configured to abut the track; and wherein the skirt panel comprises a clip configured to receive an end of the vertical leg of the track.

17. The passenger conveyor of claim 12, wherein the first member comprises a bracket including:

a first wall extending away from the skirt panel generally perpendicular thereto;

a second wall extending away from the skirt panel generally perpendicular thereto and connected in approximately perpendicular relationship to the first wall;

a third wall arranged generally parallel to the skirt panel and connected to first ends of the first and the second walls; and a fourth wall arranged generally parallel to the skirt panel and connected to second ends of the first and the second walls opposite the first ends of the first and second walls.

18. The passenger conveyor of claim 17, wherein one of the third and the fourth walls is connected to the plate by an adjustable fastener such that adjustment of the fastener moves the bracket relative to the skirt panel, said relative movement of the bracket being limited by the frame member, against which the bracket may be adjusted.

19. The balustrade assembly of claim 18, wherein the bracket can adjust a position of the skirt panel in a first direction when the bracket is adjusted to engage the frame member.

20. The passenger conveyor of claim 12, wherein the second member comprises a post connected to the plate by an adjustable fastener such that adjustment of the fastener moves the skirt panel relative to the track.

21. The balustrade assembly of claim 20, wherein the relative movement of the post is limited by the track, against which the post may be adjusted to engage.

22. The balustrade assembly of claim 21, wherein the post can adjust a position of the skirt panel in a second direction when the post is adjusted to engage the track.

23. A positioning device for a skirt panel of a passenger conveyor, the device comprising:

a plate configured to be connected to an inner face of the skirt panel facing away from a plurality of tread plates;

a bracket adjustably connected to the plate opposite the skirt panel generally perpendicular to the skirt panel, the bracket being adjustable to engage a stationary frame member of the passenger conveyor such that the bracket can adjust a position of the skirt panel in a first direction; and a post adjustably connected to the plate and extending generally parallel to the skirt panel and configured to engage a stationary track of the passenger conveyor that is arranged below the skirt panel such that the post can adjust the position of the skirt panel in a second direction.

24. The device of claim 23, wherein the skirt panel comprises a plurality of channels disposed on the inner face of the skirt panel, the plate being connected to at least one of the channels.

25. The device of claim 24, wherein the plurality of channels comprise:

a first channel to which the plate is connected by one or more fasteners; and a second channel arranged below the first channel and comprising a lip configured to be received in a slot in the plate.

26. The device of claim 25, wherein the plurality of channels further comprise a third channel arranged between the first and the second channels.

27. The device of claim 23, wherein the track comprises a vertical leg and a horizontal leg against which the post is configured to abut the track; and wherein the skirt panel comprises a clip configured to receive an end of the vertical leg of the track.

28. The device of claim 23, wherein the bracket comprises:

a first wall extending away from the skirt panel generally perpendicular thereto;

a second wall extending away from the skirt panel generally perpendicular thereto and connected in approximately perpendicular relationship to the first wall;

a third wall arranged generally parallel to the skirt panel and connected to first ends of the first and the second walls; and a fourth wall arranged generally parallel to the skirt panel and connected to second ends of the first and the second walls opposite the first ends of the first and second walls.

29. The device of claim 28, wherein one of the third and the fourth walls is connected to the plate by an adjustable fastener such that adjustment of the fastener moves the bracket relative to the skirt panel.

* * * * *